US007424096B2

(12) United States Patent
Rieger et al.

(10) Patent No.: US 7,424,096 B2
(45) Date of Patent: Sep. 9, 2008

(54) SYSTEMS AND METHODS FOR TAPE ADVANCEMENT IN LASER PRODUCED PLASMA EQUIPMENT

(75) Inventors: Harry Rieger, San Diego, CA (US); Andrew Stone, Longmont, CO (US)

(73) Assignee: JMAR Research, Inc., San Diego, CA (US)

( * ) Notice: Subject to any disclaimer, the term of this patent is extended or adjusted under 35 U.S.C. 154(b) by 652 days.

(21) Appl. No.: 11/014,303

(22) Filed: Dec. 16, 2004

(65) Prior Publication Data

US 2005/0180043 A1 Aug. 18, 2005

Related U.S. Application Data

(60) Provisional application No. 60/530,335, filed on Dec. 17, 2003.

(51) Int. Cl.

| | |
|---|---|
| ***H01J 35/08*** | (2006.01) |
| *G21G 4/00* | (2006.01) |
| *H01J 35/00* | (2006.01) |
| *B65H 23/00* | (2006.01) |

(52) U.S. Cl. ..... 378/143; 378/119; 378/126; 242/566

(58) Field of Classification Search ..... 378/119, 378/125, 126, 131, 143; 242/615.1
See application file for complete search history.

(56) References Cited

U.S. PATENT DOCUMENTS

| | | | | |
|---|---|---|---|---|
| 3,360,173 | A * | 12/1967 | Miller | 242/615 |
| 3,647,984 | A | 3/1972 | Watanabe | |
| 4,080,635 | A * | 3/1978 | Zahn et al. | 360/71 |
| 4,205,278 | A | 5/1980 | George et al. | |
| 4,630,275 | A | 12/1986 | Rapoport | |
| 4,646,308 | A | 2/1987 | Kafka et al. | |
| 4,764,826 | A | 8/1988 | Estes | |
| 4,896,341 | A | 1/1990 | Forsyth et al. | |
| 4,930,901 | A | 6/1990 | Johnson et al. | |
| 4,939,715 | A | 7/1990 | Vogelgesang et al. | |
| 5,003,543 | A | 3/1991 | Morsell | |
| 5,006,184 | A | 4/1991 | Manusch et al. | |
| 5,081,635 | A | 1/1992 | Wakabayashi et al. | |
| 5,140,600 | A | 8/1992 | Rebhan | |
| 5,157,684 | A | 10/1992 | Benda et al. | |
| 5,235,606 | A | 8/1993 | Mouroll et al. | |
| 5,315,461 | A * | 5/1994 | Todd | 360/90 |
| 5,339,323 | A | 8/1994 | Hunter et al. | |
| 5,434,875 | A | 7/1995 | Rieger et al. | |

(Continued)

*Primary Examiner*—Edward J. Glick
*Assistant Examiner*—Mona M Sanei
(74) *Attorney, Agent, or Firm*—Baker & McKenzie LLP

(57) ABSTRACT

Disclosed herein are systems and methods for advancing tape/ribbon through a targeting area where laser ablation of the tape occurs in laser produced plasma equipment. Disclosed systems include a first positioning surface perpendicular to further positioning devices, where all of the positioning components work to precisely position the advancing tape in the point source area. After the first positioning device, the remaining positioning surfaces are parallel and provide positioning forces on the tape along a single horizontal axis, but in alternately opposing directions. Such forces assist to precisely position the tape in the desired target location, and to control the rate of advancement of the tape by imparting friction on the tape in alternating, opposing directions. A steady drive roller serves to pull the tape through the system, and works in conjunction with the friction imparted by the positioning surfaces to advance the tape at a substantially constant velocity.

26 Claims, 3 Drawing Sheets

U.S. PATENT DOCUMENTS

| | | | | |
|---|---|---|---|---|
| 5,491,707 | A | 2/1996 | Rieger et al. | |
| 5,539,764 | A | 7/1996 | Shields et al. | |
| 5,544,133 | A | 8/1996 | Sin | |
| 5,668,848 | A | 9/1997 | Rieger | |
| 5,790,574 | A | 8/1998 | Rieger et al. | |
| 6,501,620 | B1 * | 12/2002 | Wojciechowski | 360/130.21 |
| 6,822,674 | B2 * | 11/2004 | Anderson et al. | 348/96 |
| 2002/0018288 | A1 | 2/2002 | Rieger et al. | |
| 2003/0052939 | A1 * | 3/2003 | Farr et al. | 347/29 |
| 2003/0076614 | A1 * | 4/2003 | Yeon | 360/73.04 |
| 2003/0210717 | A1 | 11/2003 | Rieger | |

* cited by examiner

SYSTEMS AND METHODS FOR TAPE ADVANCEMENT IN LASER PRODUCED PLASMA EQUIPMENT

PRIORITY CLAIM TO RELATED APPLICATION

This Application claims the benefit of U.S. Provisional Application Ser. No. 60/530,335, filed on Dec. 17, 2003, and entitled "Single Pass Cu Ribbon Target" commonly assigned with the present Application and incorporated herein by reference for all purposes.

TECHNICAL FIELD

Disclosed embodiments herein relate generally to laser ablation systems, and more particularly to systems and methods for advancing a tape through a targeting area where laser ablation of the tape occurs, such as in laser produced plasma applications, wherein the position of the tape is precisely held, and its rate of advancement is made substantially constant.

BACKGROUND

While many applications exist for laser produced plasma (LPP) equipment, perhaps the most common use is in photolithography for patterning semiconductor wafers. Specifically, the equipment employed for photolithography of semiconductor wafers generates high-energy plasma radiation, which is then captured and focused on the semiconductor wafer during photolithographic operations. Currently, the most common approach to generating the needed energy is to focus high intensity radiation, such as a stationary pulsed laser beam, on a moving target tape (e.g. copper, stainless steel, etc.) in order to generate x-rays. The intersection of the radiation and the tape within the target area defines a point source (at each laser pulse) from which the x-rays radiate.

Typically, in such a process, holes or spots are formed on the target tape. Since the spatial position of the x-ray point source must be stationary, the tape must move in a pattern to allow a fresh portion of the tape to be exposed to each succeeding laser pulse. The conventional approach for a target tape is to move the tape from a feed reel to a collection reel, and which utilizes a single straight line along the tape for the series of laser pulses. Other approaches may steadily move the tape horizontally as it advances through the point source area (or horizontally moving the tape after each pass from one reel to another) so that the substantial width of the tape may be used, however, a benefit to the straight-line approach is the ability to use narrow tape, which may prove to be less in overall expense. In addition, the tape in these systems is often warped by the ablation even after only one pass, which makes multiple passes for the same tape, even if moved horizontally, inefficient and difficult to do.

Disadvantages to conventional equipment using the straight-line approach include unstable x-ray generation caused by deformities in the tape formed by the laser ablation process. Also, the tape drive mechanisms found in conventional equipment capable of providing a substantially constant rate of advancement for the tape are typically very complex means of motion control that are subject to periodic failure, and are often very expensive to both purchase and maintain, not only in terms of direct cost, but also in terms of manpower and equipment downtime. Moreover, the mechanisms and components employed by conventional equipment to precisely position the tape within the targeting area are too often overly sophisticated, which may further lead to periodic failures during tape advancing and thus result in costly upkeep. Accordingly, what is needed in the art are systems and methods for advancing tape is such applications that do not suffer from the deficiencies associated with conventional approaches and equipment.

BRIEF SUMMARY

Disclosed herein are systems and methods for advancing a tape through a targeting area where laser ablation of the tape occurs. In one embodiment, a tape advancing system is disclosed wherein the tape has first and second opposing faces and wherein the second face is positioned by the system for ablation with a laser within the targeting area. In such an embodiment, the system comprises a first positioning device configured to receive the first face of the tape against a first positioning surface, and a second positioning device configured to receive the first face of the tape against a second positioning surface that is substantially perpendicular to the first positioning surface, wherein the tape is twisted by substantially 90° between the first and second positioning devices. In addition, the system includes a third positioning device configured to receive the second face of the tape against a third positioning surface that is substantially parallel to the second positioning surface, wherein the third positioning surface imparts a tensioning force to the tape against the second positioning surface as the tape is advanced through the system.

In such embodiments, the system further includes a first guide wing configured to receive the first face of the tape against a first guide wing surface that is substantially parallel to the third positioning surface to further position the tape so that the tape is aligned with the targeting area, and a second guide wing configured to receive the second face of the tape against a second guide wing surface that is substantially parallel to the first guide wing surface so that the tape passes through the targeting area. In such embodiments, the targeting area is located between the first and second guide wing surfaces. Then, the system in this embodiment includes a drive roller having a longitudinal axis parallel to the first and second guide wing surfaces and configured to receive the first or second face of the tape against its surface. As such, the tape is pressed between the drive roller and an idler roller to create a tension on the tape sufficient to pull the tape through the system at a substantially constant velocity.

In another aspect, a method for advancing a tape through such a targeting area is disclosed. In one embodiment, the method comprises receiving the tape from a tape source and imparting a first positioning force on the first face of the tape to position the tape in a first direction along a first axis. The method further includes imparting a second positioning force on the first face of the tape to position the tape in a first direction along a second axis perpendicular to the first axis, where the tape twists by 90° between the first and second positioning forces. Also in such embodiments, the method includes imparting a third positioning force on the second face of the tape to further position the tape in a second direction along the second axis opposite to the first direction along the second axis. In addition, the third positioning force imparts a tensioning force to the tape against the second positioning force as the tape is advanced through the system. Such methods further include guiding the tape into the targeting area by imparting a first guiding force on the first face of the tape to further position the tape in the first direction along the second axis, and then guiding the tape out of the targeting area by imparting a second guiding force on the second face of the tape to further position the tape in the second direction along the second axis. In addition, the method in such embodiments includes pulling the tape from the tape source at a substantially constant velocity while a position of the tape is affected by the positioning and guiding forces.

BRIEF DESCRIPTION OF THE DRAWINGS

For a more complete understanding of this disclosure, and the advantages of the systems and methods herein, reference is now made to the following descriptions taken in conjunction with the accompanying drawings, in which.

DETAILED DESCRIPTION OF PREFERRED EMBODIMENTS

Figure 1:
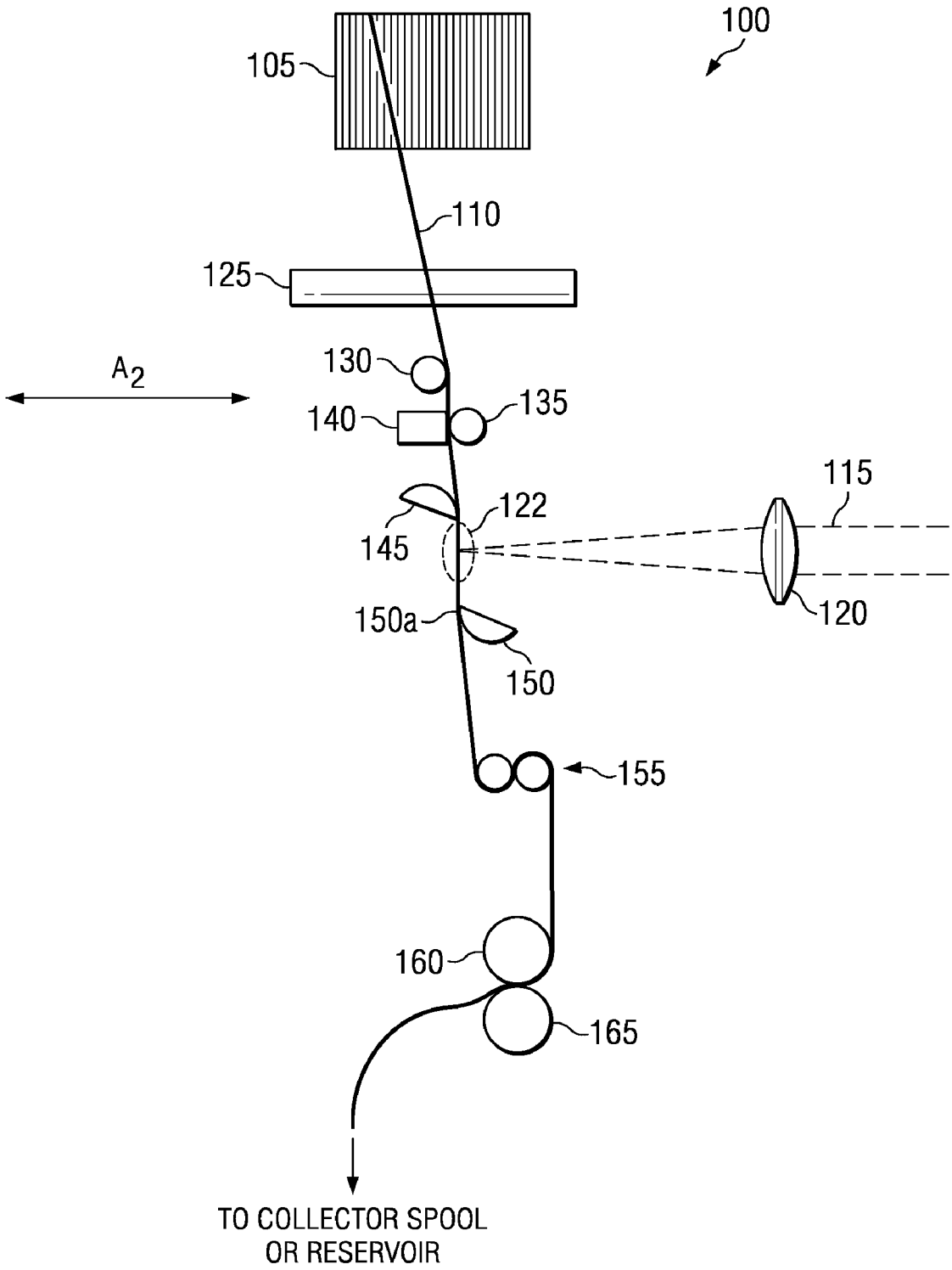
FIG. 1 illustrates a conceptual diagram of one embodiment of a tape advancing system constructed according to the principles disclosed herein.

Referring initially to FIG. 1, illustrated is a conceptual diagram of one embodiment of a tape advancing system 100 constructed according to the principles disclosed herein. The system 100 includes a spool 105 of metallic tape 110 for use in, for example, laser produced plasma (LPP) applications. Typically, the tape 110 is composed of metals, such as copper, nickel, iron, or alloys thereof, however, any type of material capable of generating x-rays when irradiated with a laser may be employed. In general, when employed in an LPP application, the disclosed system 100 may be used in photolithography machines for semiconductor manufacturing operations.

In such machines, high intensity radiation, such as a stationary, pulsed laser beam 115, may be focused on the moving target tape 110 using one or more focusing lenses 120 in order to generate x-rays. The impact of the radiation/laser 115 on the tape 110 occurs in a target area, or "point source" area 122, from which the x-rays radiate. During this x-ray generating process, holes or spots are formed on the tape 110. Thus, since the spatial position of the x-ray point source 122 is stationary, because the laser 115 is stationary, the tape 110 must move in a pattern to allow a fresh portion of the tape 110 to be exposed to each succeeding laser pulse. Therefore, as discussed above, to increase efficiency in tape use, not only should the tape advancement be consistent, but also the positioning of the tape through the point source 122 should be very precise.

To provide such precise tape advancement and positioning, the disclosed systems and methods use a series of uniquely positioned and constructed positioning or guiding surfaces on several components, wherein the surfaces provide positioning or guiding forces on the tape. For example, in the embodiment illustrated in FIG. 1, a first positioning device 125 is provided and oriented parallel to the width of the metallic target tape 110 wrapped around the spool 105. By orienting the first positioning device 125 in this manner, it is configured to receive a first face of the tape 110 against its exterior surface, which may be called a first positioning surface. More specifically, the type of target tape 110 employed has a typical flat structure, where it has two faces (first and second faces) that are substantially wider than the thickness of the tape 110. In typical applications, the tape 110 is 0.5 to 2 inches wide with a thickness of about 0.5 to 2 mil. Of course, any size tape may be used. By receiving a face of the tape 110 on the first positioning surface, the first positioning device 125 helps to position the tape 110 along, but orthogonal to, a first axis ($A_1$ in FIG. 2).

Figure 2:
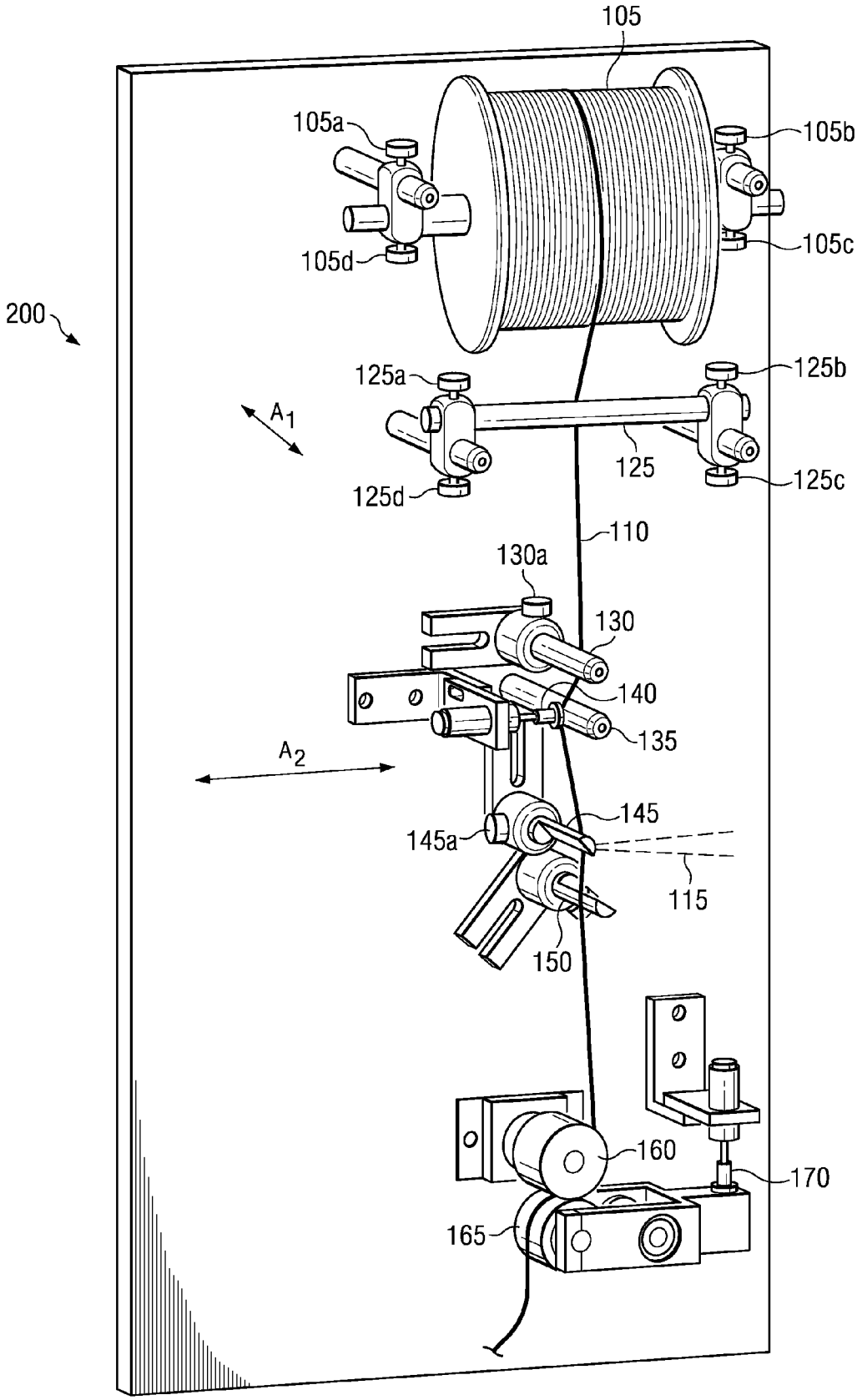
FIG. 2 illustrates an isometric view of a conceptual drawing of another embodiment of a tape advancement system constructed according to the principles disclosed herein.

In some embodiments, the longitudinal axis of the spool 105 that provides the tape 110 is parallel to a longitudinal axis of the first positioning device 125. In related embodiments, the longitudinal axis of the first positioning device 125 is located substantially in line with the longitudinal axis of the spool 105 and the longitudinal axis of a second positioning device 130 (see below), for example, directly beneath the spool 105, as seen in FIG. 2. In yet other embodiments, the first positioning device 125 (and thus its surface) is adjustable along the first axis $A_1$ to ensure that the tape 110 is in contact with its exterior surface in order to provide the position of the tape 110 along the first axis $A_1$. In addition, the first positioning device 125 may be a cylindrical rod, which provides a rounded surface over which the tape 110 passes. Also, the remaining positioning devices may also be cylindrical rods, however, no limitation to any specific shape is intended. For example, in other embodiments, the positioning devices in the system 100 may be rollers or other beneficial components. In all embodiments, the positioning devices may comprise any shape or orientation, so long as each corresponding positioning or guiding surface for the tape is oriented as described herein.

The illustrated system 100 next provides a second positioning device 130 located perpendicular to the first positioning device 125. The second positioning device 130 is configured to receive either the first or second face of the tape 110 (e.g., depending on how it is twisted when received from the first positioning device 125) against its exterior surface (the second positioning surface) in order to position the tape 110 along a second axis ($A_2$ in FIG. 2) that is perpendicular to the first axis $A_1$. Because of the perpendicular orientation of the surface of the second positioning device 130 with respect to the surface of the first positioning device 125, the tape 110 is twisted by 90° between the first and second positioning devices 125, 130. Thus, as stated above, depending on how the tape 110 twists the 90° from the surface of the first positioning device 125 to the surface of the second positioning device 130 will determine whether the first or second face of the tape 110 will be in contact with the surface of the second positioning device 130. For simplicity, in the embodiments described herein it is the first side of the tape 110 that contacts the surface of the second positioning device 130, however, it is understood that either face may be in such contact. Moreover, if it is the second face of the tape 110 that contacts the surface of the second positioning device 130, the positioning or guiding surfaces of the remaining components of the disclosed systems will typically contact the opposite face of the tape 110 than that described below, and the laser ablation would then occur on the first face of the tape 110 when it passes through the targeting area.

A surface of the third positioning device 135 (the third positioning surface) is located proximate to and parallel with the second positioning surface found on the second positioning device 130. The third positioning device 135 is configured to receive the second face of the tape 110 against this third positioning surface, when the surface of the second positioning device 130 receives the first face, to further position the tape 110 along the second axis $A_2$ in a direction opposite to that provided by the second positioning surface. In some embodiments, the longitudinal axis of the second positioning device 130 is located on substantially in line with a longitudinal axis of the third positioning device 135 (see FIG. 2) so that their corresponding positioning surfaces are also substantially in line; however, this is not required. In addition, in exemplary embodiments, the tape advancing system 100 may also include a tensioning device 140 mounted near the third positioning device 135. In such embodiments, the tensioning device 140 is configured to apply tension to the tape 110 by providing a compressing force against the first face of the tape 110 and force the tape 110 against the surface of the third positioning device 135. This tension applied to the tape 110 further helps the tape 110 to be kept taut as it passes through the targeting area 122 of the system 100, as discussed in further detail below. Moreover, although only one tensioning device 140 is illustrated putting tension on the tape 110 from when it enters the system 100 until after it exits the targeting area 122, more tensioning devices may also be included at other locations in the system 100, if desired.

Another component of the tape advancing system 100 is a first guide wing 145 having a first guide wing (e.g., guiding) surface oriented in parallel to the third positioning surface of the third positioning device 135. As the tape 110 is fed through the system 100, the surface of the first guide wing 145 is configured to receive the first face of the tape 110 (i.e., the face of the tape 110 contacting the surface of the second positioning device 130) against its first guide wing surface to further position the tape 110 along the second axis $A_2$ in a direction opposite to that provided by the third positioning device 135. In addition, the first guide wing 145 provides such positioning for the tape 110 as it enters the targeting area 122. As the tape 110 exits the targeting area 122 of the system 100, it then comes in contact with a second guide wing (e.g., guiding) surface found on a second guide wing 150, which is oriented in parallel to the surface of the first guide wing 145. The second guide wing 150 is configured to receive the second face of the tape 110 against its surface (i.e., the face of the tape 110 opposite to that received by the first guide wing 145) to further position the tape 110 along the second axis $A_2$ in a direction opposite to that provided by the surface of the first guide wing 145.

As illustrated in FIG. 1, the first and second guide wings 145, 150 in this embodiment comprise chordal cross-sections. Such chordal cross-sections may be provided to reduce the amount of debris accumulated on the guide wings 145, 150 as the tape 110 enters and exits the targeting area 122 and under goes laser ablation. For example, after the laser 115 has ablated portions of the tape 110 during the x-ray generation process, the surface of the tape 110 may contain debris and other remnants from the ablation process. As debris builds-up on the components of a tape advancement system, malfunctions may result that can affect the consistency in the rate of tape advancement, as well as the position of the tape when passing through the targeting area 122. By employing the disclosed chordal cross-sections for the guide wings 145, 150, the first and second faces of the tape 110 contact the corresponding guide wings 145, 150 proximate to the point on the exterior surfaces of the guide wings 145, 150 where the curved surface (i.e., an arcuate surface) meets the flat surface of the chordal cross-section. Particularly at the second guide wing 150, less debris accumulation occurs because much of the debris on the second face of the tape 110 created during laser ablation is scraped off of that surface of the tape 110, rather than being allowed to accumulate between the tape 110 and the arcuate surface of the second guide wing 150. This debris may then simply slide down the flat side of the guide wing 150 and out of the path of the advancing tape 110.

The tape advancing system 100 of FIG. 1 also includes a set of pinch rollers 155 positioned to receive the tape 110 from the second guide wing 150 after the laser ablation has taken place. During the laser ablation process, craters and other anomalies or deformations that affect the flatness of the tape 110 may be left on the tape 110 by the laser ablation process, and these topographic changes can affect the advancement of the tape 110 as the used tape is collected. To combat this potential problem, the set of pinch rollers 155 may be provided to compress the tape 110 between the rollers to reduce such surface protrusions. Thus, tape 110 will typically be made substantially flat by the pinch rollers 155 before received by the disclosed tape drive mechanism.

More specifically, after the tape 110 has been compressed by the pinch rollers 155, the tape 110 passes through a drive roller 160 having a longitudinal axis parallel to respective surfaces of the first and second guide wings 145, 150, and which is used to steadily pull and thus advance the tape 110 through the previously discussed components of the system 100. The tape 110 is received between the drive roller 160 and an idler roller 165 to create a non-slip tension on the tape 110 sufficient to pull the tape 110 through the system 100. To advance the tape 110, the shaft of a simple drive motor may be coupled to the drive roller 160 to turn the roller 160 at a substantially constant velocity to advance the tape 110 through the system 100 at a constant rate. In other embodiments, gears, for example, a planetary gearbox, may be used from the shaft of a drive motor to the drive roller 160 to advance the tape 110 through the system 100.

In either embodiment, the friction imparted to the tape 110 by the alternating, opposing redirections provided by the surfaces of the multiple positioning components helps to regulate the velocity at which the tape 110 is pulled through the system 100. Thus, even if an imprecise drive motor is employed in the system 100, inconsistencies in the rate at which the inexpensive drive motor pulls the tape 110 through the system 100 may be compensated for by the regulation realized through the alternating, opposing redirections of the tape 110 provided by these components. Moreover, the composition of the drive roller 160 and the idler roller 165, as well as the compression between the two, may be selected so as to compress the tape 110 to reduce distortions or protrusions on the tape 110, either in addition to or in place of the pinch rollers 155 discussed above. As the used tape 110 is advanced by the drive roller 160, it may then be discarded to a reservoir or even wound about a collector spool for discarding or recycling at a later time.

Turning now to FIG. 2, illustrated is an isometric view of another embodiment of a tape advancement system 200 constructed according to the principles disclosed herein. The system 200 illustrated in FIG. 2 includes several components of the system 100 illustrated in FIG. 1, while providing additional beneficial features. This system 200 again includes a spool 105 for providing a metallic tape 110 for use in generating x-rays through a laser ablation process. The tape 110 is pulled from the spool 105 and is positioned along the first axis $A_1$ by the surface of a first positioning device 125.

In this embodiment, both the spool 105 and the first positioning device 125 (and thus its surface) are adjustable with respect to both the first and second axes $A_1$, $A_2$. Specifically, the spool 105 is mounted with adjusting devices 105*a*, 105*b* to allow the spool 105 to be slid along the first axis $A_1$, as well as adjusting devices 105*c*, 105*d*, to allow the spool 105 to be slid along the second axis $A_2$. Likewise, the first positioning device 125 includes adjusting devices 125*a*, 125*b* to allow the first positioning device 125 to be slid along the first axis $A_1$, as well as adjusting devices 105*c*, 105*d* to allow the first positioning device 125 to be slid along the second axis $A_2$. By providing such adjustment to the spool 105 and/or the first positioning device 125, the longitudinal axiss of these components may be adjusted with respect to one another so as to provide the desired amount of redirection for the tape 110 as it is taken from the spool 105 and fed around the first positioning device 125 by its first positioning surface.

As with the system 100 illustrated in FIG. 1, the tape 110 passes from the first positioning device 125 in this system 200 to the second and third position devices 130, 135, each having their respective positioning surfaces described above. In this embodiment, the location of the second positioning device 130 (and thus its surface) is also adjustable. Specifically, an adjusting device 130*a* is provided for the second positioning device 130 so that the longitudinal axis of this device 130 is adjustable with respect to the third positioning device 135. The location of the surface of the second positioning device 130 is adjustable with respect to the surface of the third positioning device 135 using this device 130*a* so as to provide the desired amount of redirection for the tape 110 as it passes between the surfaces of these components.

As with the adjustment described above, the redirection of the tape 110 between the surfaces of any two components can provide more or less friction to the surfaces of the tape 110 at various stages of the tape advancement system 200, which allows the operator to fine-tune the advancement of the tape 110 as desired. This system 200 again includes a tensioning device 140 to provide a compression of the tape 110 against the surface of the third positioning device 135 so as to further create a tension on the advancing tape 110, as discussed above. While a solenoid-type tensioning device 140 is illustrated in this embodiment, any type of tensioning device may be employed, as desired.

Once the tape 110 leaves the tensioning device 140, it again is passed to the first and second guide wings 145, 150, which again define the targeting area 122 where a laser 115 impacts the tape 110 to create a point source (with each laser pulse) that generates the desired x-rays. In this embodiment, the first and second guide wings 145, 150 again have chordal cross-sections to help reduce the amount of debris accumulated on the guide wings 145, 150 as the tape 110 enters and exits the targeting area 122, contacting the first and second guide wing surfaces. In addition, in this embodiment, the first and second guide wings 145, 150 are also each rotationally adjustable to control each contact point on their respective surfaces for the tape 110. As a result, adjusting devices 145*a*, 150*a* for each of the first and second guide wings 145, 150, respectively, may be employed to precisely adjust where the corresponding surfaces of the tape 110 contact the guide wings 145, 150 proximate to the point on each of the guide wings 145, 150 where the arcuate surface meets the flat surface of their chordal cross-section.

Finally, as in the prior embodiment, the tape 110 passes between a drive roller 160 and an idler roller 165, which work together to provide the compression of the tape 110 and the advancement of the tape 110 through the system 200. In addition, in this embodiment, pinch rollers are not employed to further assist in flattening the tape 110 after the ablation process. Furthermore, the compression between the drive and idler rollers 160, 165 is adjustable in this embodiment of the system 200 using another tensioning device 170. As illustrated, this tensioning device 170 may be employed to drive the idler roller 165 towards the drive roller 160 via a pivot point in the structure. Of course, any type of tensioning device may be employed in this part of the system 200 to provide the desired tension. Moreover, the provided tension may simply be to create a non-slip grip on the tape 110 between the drive roller 160 and the idler roller 165 during operation of the system 200, rather than creating a compression on the tape 110 to affect its flatness.

Figure 3:
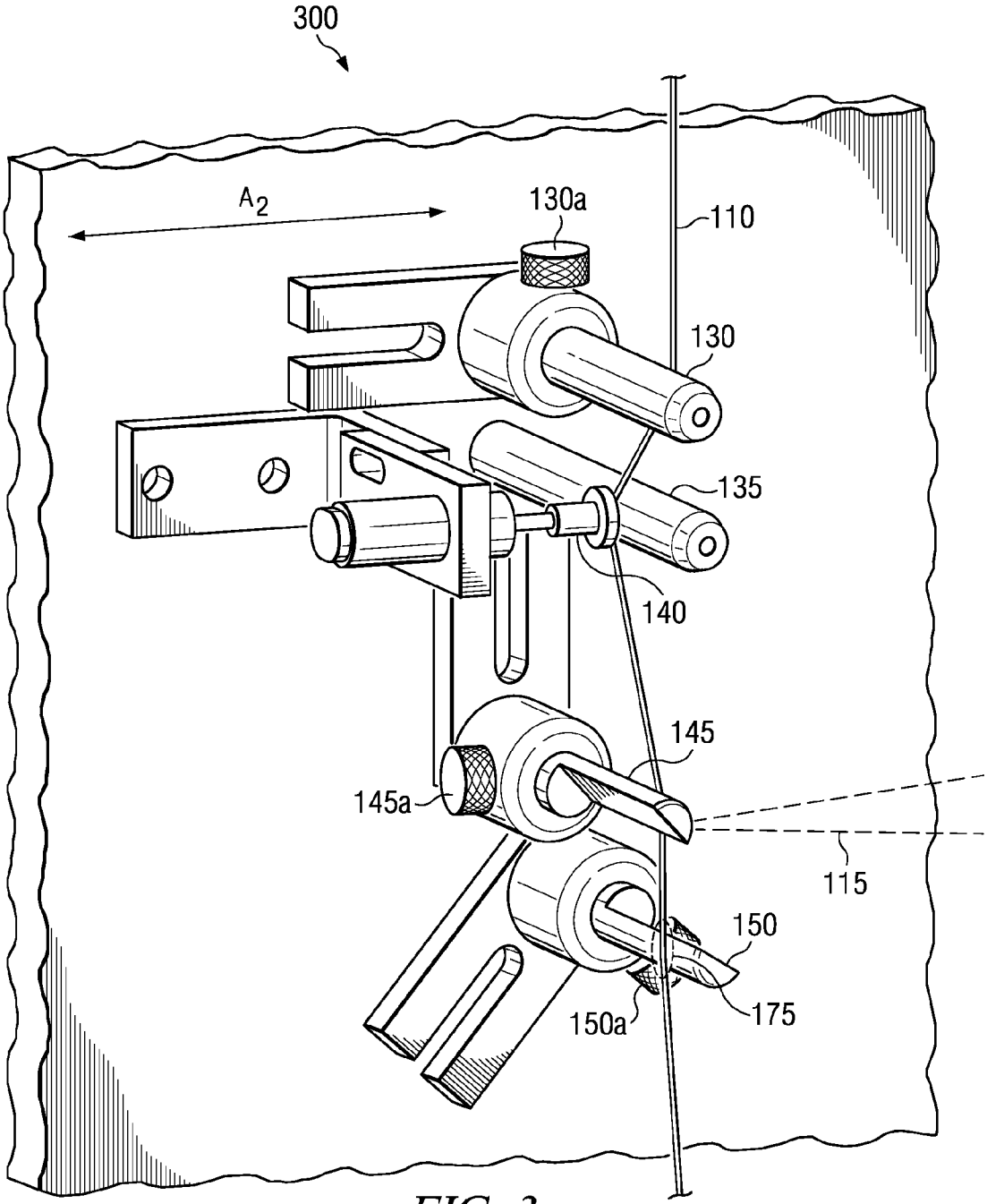
FIG. 3 illustrates is a close-up view proximate to the point source area of the tape advancement system illustrated in FIG. 2.

In FIG. 3, a close-up view 300 proximate to the targeting area 122 of the tape advancement system 200 of FIG. 2 is depicted. This view 300 provides a more detailed illustration of the tape 110 as it passes from the second positioning device 130 through to the second guide wing 150. This view 300 clearly shows the multiple changes in direction imparted on the tape 110 by the surfaces of these various components as it is advanced through the system 200. The back-and-forth direction change imparted on the tape 110 along the second axis $A_2$ helps steady the rate of advancement of the tape 110 through the targeting area 122, as well as the location of the tape 110 when the laser 115 impacts it to form a point source.

More specifically, the surface of the third positioning device 135 is shown positioning the tape 110 such that the surface of the tape 110 is perpendicular to the second axis $A_2$, and imparting a tensioning force to the tape 110 along the second axis $A_2$ (i.e., pushing out on the tape 110) in a direction opposite to that provided by the second positioning device 130. Then, the first guide wing surface of the first guide wing 145 redirects the tape 110 in an opposite direction to that provided by the third positioning device 135, and back in the same direction as that provided by the second positioning device 130. The second guide wing surface of the second guide wing 150 then again redirects the tape 110 along the second axis $A_2$ back again in the direction provided by the third positioning device 135. This back-and-forth repositioning/redirecting of the tape 110 along a single axis ($A_2$), while the surface of the tape 110 remains substantially perpendicular to this single axis, helps keep a steady tension on the tape 110 during its advancement so that it advances through the targeting area 122 at a substantially steady rate.

Moreover, by adjusting the individual positions. of these various components, and thus their respective surfaces, with respect to one another, the amount of friction applied to the tape 110 at corresponding points of its advancement through the system 200 is adjusted to further regulate the rate the tape's 110 advancement through the system 200, as well as its position during the ablation process. Still further, a groove 175 may be provided in the second guide wing 145 to help further maintain lateral positioning of the tape 110 near the point source area 122. For example, as illustrated, the groove 175 may be formed having a width only slightly larger than the width of the tape 110 so that the lateral position of the tape 110 (i.e., along the first axis $A_1$) may be maintained. In embodiments employing a groove 175, the second guide wing surface that contacts the tape 110 may now be found within the groove 175, at its bottom surface. While a groove 175 is not required, one may be included not only on the second guide wing 150 but also on the first guide wing 145, if desired.

By employing a tape advancement system, or a method for advancing tape, in accordance with the principles disclosed herein, several advantages over conventional approaches may be realized. Specifically, employing first and second positioning surfaces that are perpendicularly oriented to one another assists in precisely positioning the advancing tape in a targeting area. In addition, providing components having surfaces that provide positioning force on the tape along the same horizontal axis, but in alternatingly opposing directions, further assists to not only precisely position the tape in a desired target location, but also to control or regulate the rate of advancement of the tape by imparting friction on the tape in alternating, opposing directions. Such friction may be further controlled by constructing these positioning components to be adjustable along this axis, as well as through the use of tensioning devices that impart further friction to the advancing tape at one or more of these positioning components.

Furthermore, imparting such friction on the tape in alternating but opposing directions along the same axis provides further benefit by keeping the tape taut during its path through the system, thus preventing wrinkling, tearing, or other imprecise positioning of the tape while in use in the system. Still further, while reinforced tapes may be employed in conventional systems in an effort to achieve some of these benefits, the disclosed systems/methods can provide the desired benefits without necessitating the expense involved with such reinforced tape products. Additionally, while complex drive mechanisms may be employed to help regulate the rate at which the tape is advanced through the system, system and methods as disclosed herein provide the same or similar benefits without the undesirable purchase and maintenance costs, or the downtime commonly associated with such complex drive mechanisms.

While various embodiments of tape advancing systems, and methods for maneuvering a tape through a targeting area, according to the principles disclosed herein have been described above, it should be understood that they have been presented by way of example only, and not limitation. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A tape advancing system for precisely advancing a tape through a targeting area, the tape having first and second opposing faces wherein the second face is positioned by the system for irradiation by a laser within the targeting area, the system comprising:

a first positioning device configured to receive the first face of the tape against a first positioning surface;

a second positioning device configured to receive the first face of the tape against a second positioning surface that is substantially perpendicular to the first positioning surface, the tape twisting by substantially 90° between the first and second positioning devices;

a third positioning device configured to receive the second face of the tape against a third positioning surface that is substantially parallel to the second positioning surface, wherein the third positioning surface imparts a tensioning force to the tape against the second positioning surface as the tape is advanced through the system;

a first guide wing configured to receive the first face of the tape against a first guide wing surface that is substantially parallel to the third positioning surface to further position the tape so that the tape is aligned with the targeting area;

a second guide wing configured to receive the second face of the tape against a second guide wing surface that is substantially parallel to the first guide wing surface so that the tape passes through the targeting area; and a drive roller having a longitudinal axis parallel to the first and second guide wing surfaces and configured to receive the first or second face of the tape against its surface, wherein the tape is pressed between the drive roller and an idler roller to create a tension on the tape sufficient to pull the tape through the system.

2. A tape advancing system according to claim 1, wherein the positioning devices comprise cylindrical rods.

3. A tape advancing system according to claim 1, wherein the tape is provided on a spool having a longitudinal axis parallel to a longitudinal axis of the first positioning device.

4. A tape advancing system according to claim 3, wherein the first surface of the tape is in contact with the first positioning surface as the tape is exhausted from the spool.

5. A tape advancing system according to claim 4, wherein the first positioning device is adjustable along a first plane that is substantially orthogonal to the first and second surfaces of the tape to ensure that the first surface of the tape is in contact with the first positioning surface as the tape is exhausted from the spool.

6. A tape advancing system according to claim 1, further comprising a tensioning device configured to apply tension to the tape by providing a compressing force against the first face of the tape towards the third positioning surface of the third positioning device.

7. A tape advancing system according to claim 1, wherein the first and second guide wings comprise chordal cross-sections wherein the first and second guide wing surfaces are proximate to the point on the exterior surfaces of the first and second guide wings where an arcuate surface meets a flat surface of the chordal cross-section.

8. A tape advancing system according to claim 7, wherein the first and second guide wings are each rotationally adjustable to control the rotational position of the first and second guide wing surfaces.

9. A tape advancing system according to claim 7, wherein the flat surface of the second guide wing is oriented toward the first guide wing such that the tape contacts an edge of the second guide wing where a flat surface meets an arcuate surface of its chordal cross-section.

10. A tape advancing system according to claim 9, wherein the angle between the flat surface of the second guide wing and the second face of the tape is greater than 90°.

11. A tape advancing system according to claim 1, further comprising a groove formed in the exterior surface of the second guide wing surface for receiving the tape therein, wherein a width of the groove is slightly larger than the width of the tape.

12. A tape advancing system according to claim 1, wherein the idler roller is adjustable with respect to the drive roller in order to adjust the amount of tension provided to the tape as the tape is advanced through the system.

13. A tape advancing system according to claim 1, further comprising pinch rollers configured to receive the tape from the second guide wing and to compress the tape therebetween to reduce surface protrusions on the tape.

14. A tape advancing system according to claim 1, wherein the tape is pressed between the drive roller and an idler roller to create a tension on the tape sufficient to pull the tape through the system at a substantially constant velocity.

15. A method for advancing a tape through a targeting area, the method comprising:

receiving a tape having first and second opposing faces, wherein the second face is positioned for irradiation by a laser within a targeting area, from a tape source;

imparting a first positioning force on the first face of the tape to position the tape in a first direction along a first axis;

imparting a second positioning force on the first face of the tape to position the tape in a first direction along a second axis perpendicular to the first axis, the tape twisting by 90° between the first and second positioning forces;

imparting a third positioning force on the second face of the tape to further position the tape in a second direction along the second axis opposite to the first direction along the second axis, the third positioning force imparting a tensioning force to the tape opposite to the second positioning force as the tape is advanced through the system;

guiding the tape into the targeting area by imparting a first guiding force on the first face of the tape to further position the tape in the first direction along the second axis;

guiding the tape out of the targeting area by imparting a second guiding force on the second face of the tape to further position the tape in the second direction along the second axis; and pulling the tape from the tape source while a position of the tape is affected by the positioning and guiding forces.

16. A method according to claim 15, wherein any or all of the positioning forces are adjustable in their respective directions.

17. A method according to claim 15, further comprising applying tension to the tape to slow its advance substantially where the third positioning force is applied to the tape.

18. A method according to claim 15, wherein guiding the tape into the targeting area by imparting a first guiding force further comprises imparting the first guiding force with a first guide wing surface.

19. A method according to claim 15, wherein guiding the tape out of the targeting area by imparting a second guiding force further comprises imparting the second guiding force with a second guide wing surface.

20. A method according to claim 19, wherein imparting the second guiding force further comprises orienting a flat surface of a second guide wing towards the targeting area.

21. A method according to claim 15, further comprising imparting a fourth positioning force on the edges of the tape and along the first axis.

22. A method according to claim 21, wherein the fourth positioning force is applied by the second guide wing.

23. A method according to claim 15, further comprising compressing the first and second surfaces of the tape with a compression force after it exits the targeting area.

24. A method according to claim 23, wherein the compression force is employed for the pulling of the tape.

25. A method according to claim 23, wherein the compression force is adjustable.

26. A method according to claim 15, further comprising pulling the tape from the tape source at a substantially constant velocity while a position of the tape is affected by the positioning and guiding forces.

* * * * *